US006568928B2

(12) United States Patent
Gennami et al.

(10) Patent No.: US 6,568,928 B2
(45) Date of Patent: May 27, 2003

(54) SCROLL-TYPE COMPRESSOR

(75) Inventors: Hiroyuki Gennami, Kariya (JP); Kazuhiro Kuroki, Kariya (JP); Kenji Isomura, Kariya (JP); Shinji Tsubai, Kariya (JP); Naohiro Nakajima, Kariya (JP); Yasushi Watanabe, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 0 days.

(21) Appl. No.: 10/026,275

(22) Filed: Dec. 19, 2001

(65) Prior Publication Data

US 2002/0085938 A1 Jul. 4, 2002

(30) Foreign Application Priority Data

Dec. 28, 2000 (JP) ..... 2000-399675

(51) Int. Cl.[7] ..... F03C 2/00

(52) U.S. Cl. ..... 418/55.4; 418/55.5; 418/149; 418/188

(58) Field of Search ..... 418/55.4, 188, 418/149, 55.5

(56) References Cited

U.S. PATENT DOCUMENTS 4,992,032 A 2/1991 Barito et al.
5,040,952 A * 8/1991 Inoue et al. ..... 418/55.1
6,193,485 B1 * 2/2001 Ueda et al. ..... 418/55.1
6,264,444 B1 * 7/2001 Nakane et al. ..... 418/55.4

FOREIGN PATENT DOCUMENTS

EP 1087141 A2 * 3/2001 ..... F04C/18/02
JP 08-338376 12/1996

* cited by examiner

*Primary Examiner*—Thomas Denion
*Assistant Examiner*—Theresa Trieu
(74) *Attorney, Agent, or Firm*—Knoble & Yoshida, LLC

(57) ABSTRACT

A scroll-type compressor has a fixed scroll member, a movable scroll member, a front housing, a rear housing and a gasket seal. The fixed scroll member and the movable scroll member cooperate to form a compression region. The movable scroll member orbits relative to the fixed scroll member to compress refrigerant in the compression region. A movable scroll base plate of the movable scroll member forms a rear surface and a discharge hole substantially at the center of the movable scroll base plate. Pressure of the refrigerant discharged from the compression region is applied to the rear surface of the movable scroll base plate. The front housing accommodates the movable scroll member. The rear housing which is adjacent to the front housing, has the fixed scroll member inside. The gasket seal is located between the front housing and the rear housing.

16 Claims, 4 Drawing Sheets

SCROLL-TYPE COMPRESSOR

BACKGROUND OF THE INVENTION

The present invention relates to a scroll-type compressor and more particularly to an improvement of sealing structure for securing end surfaces of housings of the compressor.

In general, the scroll-type compressor has a housing in which a fixed scroll member and a movable scroll member are provided. The fixed scroll member has a fixed scroll base plate and a fixed scroll volute portion that extends from the fixed scroll base plate. The movable scroll member has a movable scroll base plate and a movable scroll volute portion that extends from the movable scroll base plate Each volute portion is engaged with each other. The fixed scroll member and the movable scroll member cooperate to form a compression chamber as a compression region. As the movable scroll member orbits about an axis of the fixed scroll member, the compression chamber moves radially inward while its volume decreases.

As a typical prior art, Unexamined Japanese Patent Publication No. 8-338376 is known. In this constitution, as shown in FIG. 4, a fixed scroll member 111 is used as a center housing. Herein, a scroll-type compressor according to the above publication is turned to a scroll-type compressor as shown in FIG. 4 at an angle of 180 degrees for convenience. A front housing 112 and a rear housing 113 are respectively secured to front and rear sides of the center housing. The fixed scroll member 111 has a fixed scroll base plate 111*a* and a fixed scroll volute portion 111*b* that extends from the fixed scroll base plate 111*a*. A discharge port 111*c* for discharging compressed refrigerant is formed substantially at the center of the fixed scroll base plate 111*a*. The movable scroll member 118 has a movable scroll base plate 118*a* and a movable scroll volute portion 118*b* that extends from the movable scroll base plate 118*a*. The movable scroll volute portion 118*b* is placed to engage the fixed scroll volute portion 111*b* of the fixed scroll member 111. The fixed scroll member 111 and the movable scroll member 118 cooperate to form a plurality of compression chambers 120 as a compression region. The movable scroll member 118 is rotated by a drive shaft 114 connected to an external drive source. The movable scroll member 118 orbits about an axis of the fixed scroll member 111. Thus, the compression chambers are gradually compressed.

Still referring to FIG. 4, a ring-shaped fixed plate 126 is placed on an inner wall of the front housing 112. The front housing 112 is secured to the rear surface of the movable scroll base plate 118*a*. In the above compression mechanism, compression reactive force arises in accordance with compressing the refrigerant in the compression chambers 120. The compression reactive force in the direction of the axis acts on the fixed plate 126 through the movable scroll member 118.

In the above prior art, however, dimensional tolerance between height $H_1$ of the fixed scroll volute portion 111*b* and height $H_2$ of the movable scroll volute portion 118*b* is required to be adjusted. Therefore, the fixed plate 126 is alternatively fitted between the front housing 112 and the movable scroll member 118. Thus, a first distal end 111*d* of the fixed scroll volute portion 111*b* and a second distal end 118*d* of the movable scroll volute portion 118*b* are adjusted so that sealing performance is substantially equal at both ends. In this case, a plurality of the fixed plates 126 having different thickness is prepared. For example, each fixed plate 126 has a difference in thickness by 10 micrometer. When a compressor is assembled, the fittest fixed plate 126 is selected from a group of the fixed plates 126. That is, spare fixed plates 126 are required to be prepared and available for the trial and error. Therefore, the assembly requires a lot of man-hour.

In the above prior art, an O-ring seal 130 for creating a seal is placed between the fixed scroll member 111 and the front housing 112. To place the O-ring seal 130, a groove for the O-ring 130 is required to be formed. The groove is required to be accurately formed. Therefore, the machining cost becomes relatively high. Furthermore, such O-rings are required to be excellent in both sealing performance and durability. This also increases costs of the production.

SUMMARY OF THE INVENTION

The present invention addresses a scroll-type compressor having a sealing structure that has high sealing performance.

According to the present invention, a scroll-type compressor has a fixed scroll member, a movable scroll member, a rear housing, a front housing and a gasket seal. The fixed scroll member has a fixed scroll base plate and a fixed scroll volute portion. The movable scroll member has a movable scroll base plate and a movable scroll volute portion. The fixed scroll member and the movable scroll member cooperate to form a compression region. The movable scroll member orbits relative to the fixed scroll member to compress refrigerant in the compression region The movable scroll base plate forms a rear surface and a discharge hole. Pressure of the refrigerant discharged from the compression region is applied to the rear surface of the movable scroll base plate for enhancing a sealing effect in the compression region. The rear housing accommodates the fixed scroll member. The front housing is located adjacent to the rear housing for accommodating the movable scroll member. The gasket seal is located in contact with and between the front housing and the rear housing.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A scroll-type compressor according to a preferred embodiment of the present invention will be described with reference to FIGS. 1*a* through 3.

Figure 1A:
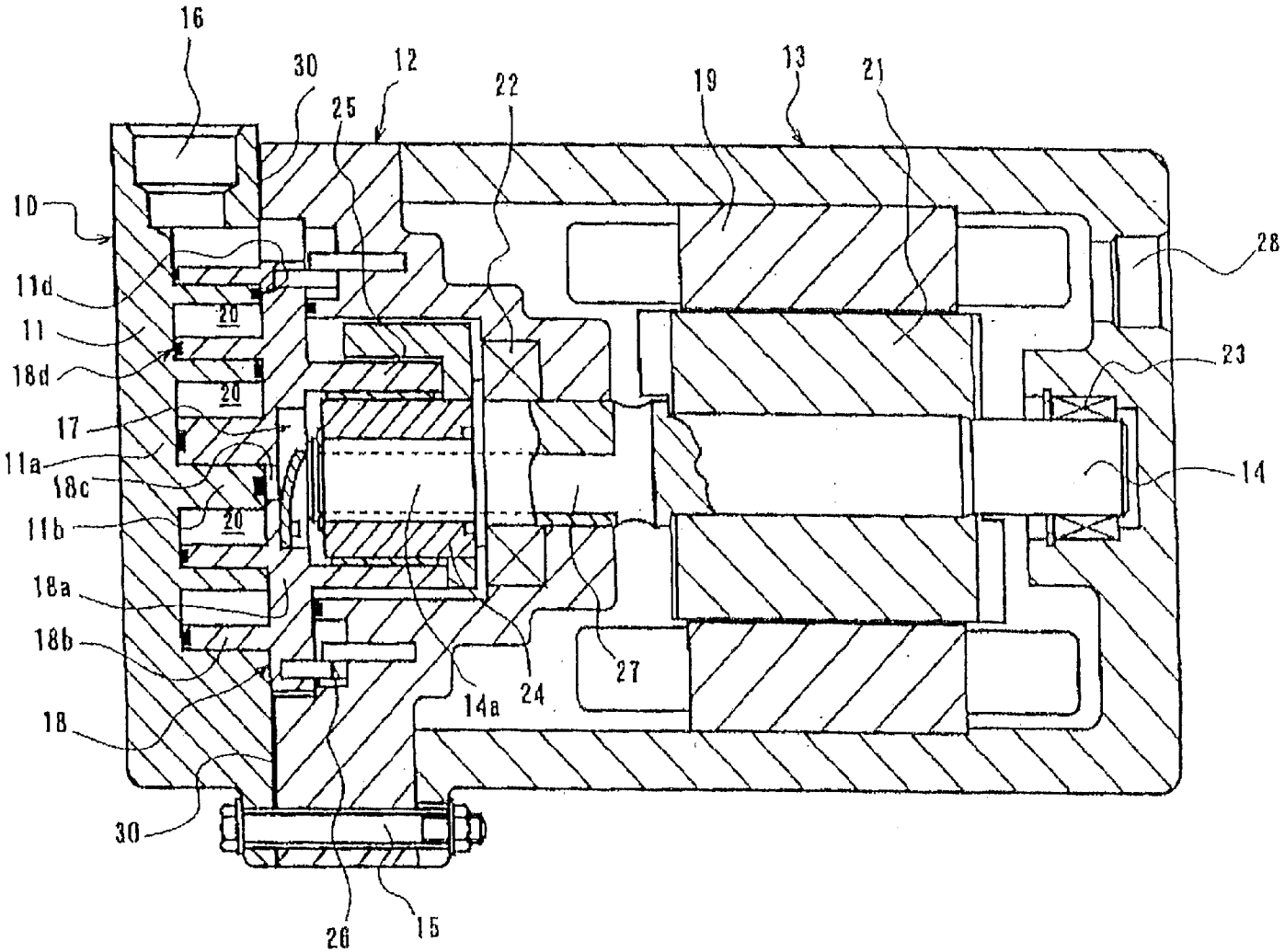
FIG. 1*a* is a diagram in a cross-sectional view illustration a preferred embodiment of the scroll-type compressor according to the present invention.

As shown in FIGS. 1*a* and *b*, a rear housing 10, a front housing 12 and a motor housing 13 are fixedly bolted by a bolt 15 to form a configuration of the compressor. A fixed scroll member 11 has a fixed scroll base plate 11*a* and a fixed scroll volute portion 11*b* that extends from the fixed scroll base plate 11*a*. The fixed scroll member 11 is integrally formed with the rear housing 10. An inlet 16 for introducing refrigerant is formed in the rear housing 10 and is connected to an external refrigerant circuit. A movable scroll member 18 is at least partially accommodated by the rear housing 10 and may extend in a space between the rear housing 10 and the front housing 12. The movable scroll member 18 has a movable scroll base plate 18*a* and a movable scroll volute portion 18*b* that extends from the movable scroll base plate 18*a*. The fixed scroll volute portion 11*b* and the movable scroll volute portion 18*b* engage with each other. Thereby, a plurality of compression chambers 20 is formed as a compression region between the fixed scroll member 11 and the movable scroll member 18. A discharge hole 18*c* is formed substantially at the center of the movable scroll base plate 18*a* of the movable scroll member 18. Compressed refrigerant in the compression chambers 20 is discharged into a discharge chamber 17 on the rear surface of the movable scroll base plate 18 through the discharge hole 18*c*.

Still referring to FIG. 1*a,* a drive shaft 14 is rotatably supported in the motor housing 13 by a first bearing 22 and a second bearing 23. A stator 19 is fixedly placed on an inner wall of the motor housing 13. A rotor 21 is fixedly mounted on the drive shaft 14 to correspond to the stator 19. A crankshaft 14*a* is mounted on the drive shaft 14. The crankshaft 14*a* is received by a bushing 24, which is inserted in a boss 25 of the movable scroll member 18. A self rotation blocking mechanism 26 prevents the movable scroll member 18 from rotating about its axis. As the crankshaft 14*a* rotates, the movable scroll member 18 orbits about an axis of the fixed scroll member 11. A discharge passage 27 is formed inside the drive shaft 14 in parallel to the bushing 24 to communicate the discharge chamber 17 with a space in the motor housing 13. A discharge port 28 is formed in the motor housing 13 for flowing discharged refrigerant into the external refrigerant circuit.

Figure 2:
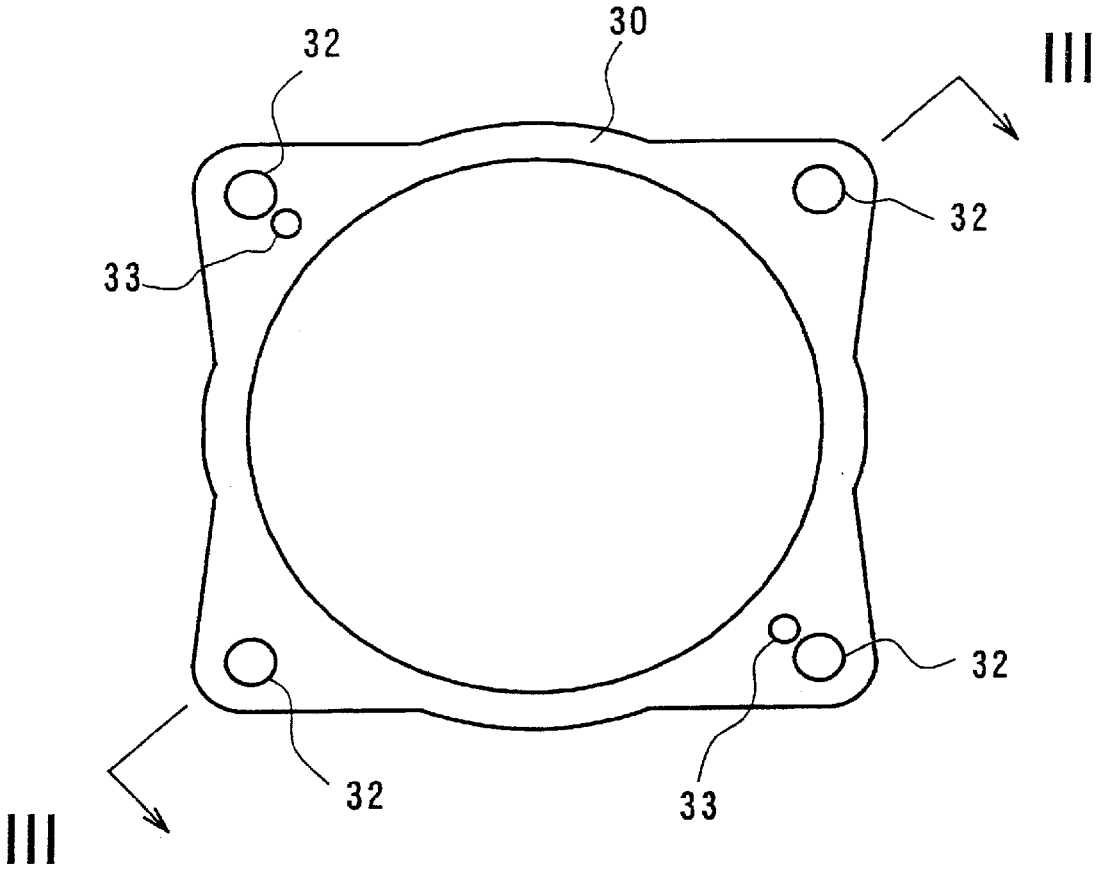
FIG. 2 is a plan view illustrating a gasket seal used in the scroll-type compressor according to the present invention.
Figure 3:
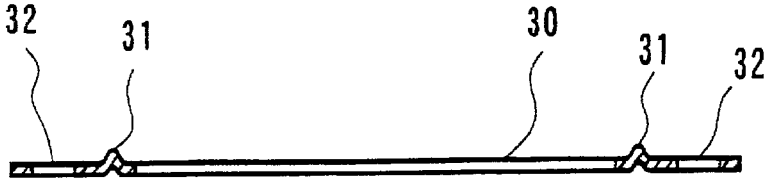
FIG. 3 is a cross-sectional view as seen at a line III—III in FIG. 2 illustrating the gasket seal used in the scroll-type compressor according to the present invention.

Referring to FIG. 1a in combination with FIGS. 2 and 3, a gasket seal 30 is placed between the front end surface of the rear housing 10 and the rear end surface of the front housing 12. The gasket seal 30 is an iron plate which is in the shape that corresponds to each end surface. The gasket seal 30 has two surfaces for sealing the rear housing 10 and the front housing 12. A continuous protrusion 31 is formed on one of the surfaces. The surfaces of the iron plate are coated with rubber A first hole 32 is formed for receiving the bolt 15 at four corners in the iron plate. A second hole 33 is also formed for receiving a pin which determines distance between the rear housing 10 and the front housing 12.

Now, the function of the scroll-type compressor according to the above preferred embodiment of the present invention will be explained with reference to FIG. 1*a* The stator 19 and the rotor 21 form an electric motor, When a current is supplied to the stator 19, the rotor 21 and the drive shaft 14 rotate integrally. At this time, the movable scroll member 18 orbits about the axis of the fixed scroll member ii in accordance with rotational movement of the drive shaft 14. As the movable scroll member 18 orbits each of the compression chambers 20 moves radially inward while its volume decreases. Refrigerant in the external refrigerant circuit is introduced into the compression chambers 20 through the inlet 16 and is compressed to a predetermined pressure value. The compressed refrigerant is discharged into the discharge chamber 17 through the discharge hole 18*c*. The discharged refrigerant in the discharge chamber 17 is turned to the external refrigerant circuit through the discharge passage 27, the space in the motor housing 13 and the discharge port 28.

Still referring to FIG. 1*a,* during the above described circulation, the pressure of the refrigerant in the discharge chamber 17 is applied to the rear surface of the movable scroll base plate 18*a*. That is, the movable scroll member 18 is constantly urged against the fixed scroll member 11 Therefore, a first distal end 11*d* of the fixed volute portion 11*b* and a second distal end 18*d* of the movable volute portion 18*b* are maintained to have contact with an opposing surface to have a sealing effect. Thus, the sealing performance is maintained by the urging force even though there is dimensional tolerance in height of the first distal end 11*d* and the second distal end 18*d*. The above described urge causes a movement of the movable scroll member 18 towards the fixed scroll member 11 in a rearward direction. Accordingly, the gasket seal 30 creates a sufficient seal between the front end surface of the rear housing 10 and the rear end surface of the front housing 12. When the compressor is assembled, the gasket seal 30 is placed between the front end surface of the rear housing 10 and the rear end surface of the front housing 12. The protrusion 31 is flattened therebetween by the bolt 15, thereby fitting to both of the surfaces. In addition, rubber on the protrusion 31 sticks to both of the surfaces, thereby creating a sufficient seal.

In the above preferred embodiment, the following effects are obtained. The movable scroll member 18 is urged against the fixed scroll member 11 by utilizing pressure of the discharged refrigerant. Therefore, the seal in the compression chambers 20 is securely retained without mechanical urging means.

As described above, mechanical means for urging the movable scroll member 18 is not utilized. When the gasket seal 30 is bolted by the bolt 15, the gasket seal 30 has relatively large amount of dimensional tolerance. Therefore, the gasket seal 30 is used to create a seal between the front end surface of the rear housing having the fixed scroll member 11 and the rear end surface of the front housing having the movable scroll member 18. As a result, the production cost is substantially reduced.

The rear housing 10 and the fixed scroll member 11 are integrally formed. Therefore, when the rear housing 10 and the fined scroll member 11 are combined with each other, dimension between the rear housing 10 and the fixed scroll member 11 is easily adjusted In addition, the rear housing 10 and the fixed scroll member 11 are designed and manufactured in a relatively flexible manner. As a result, quality products are obtained.

Figure 1B:
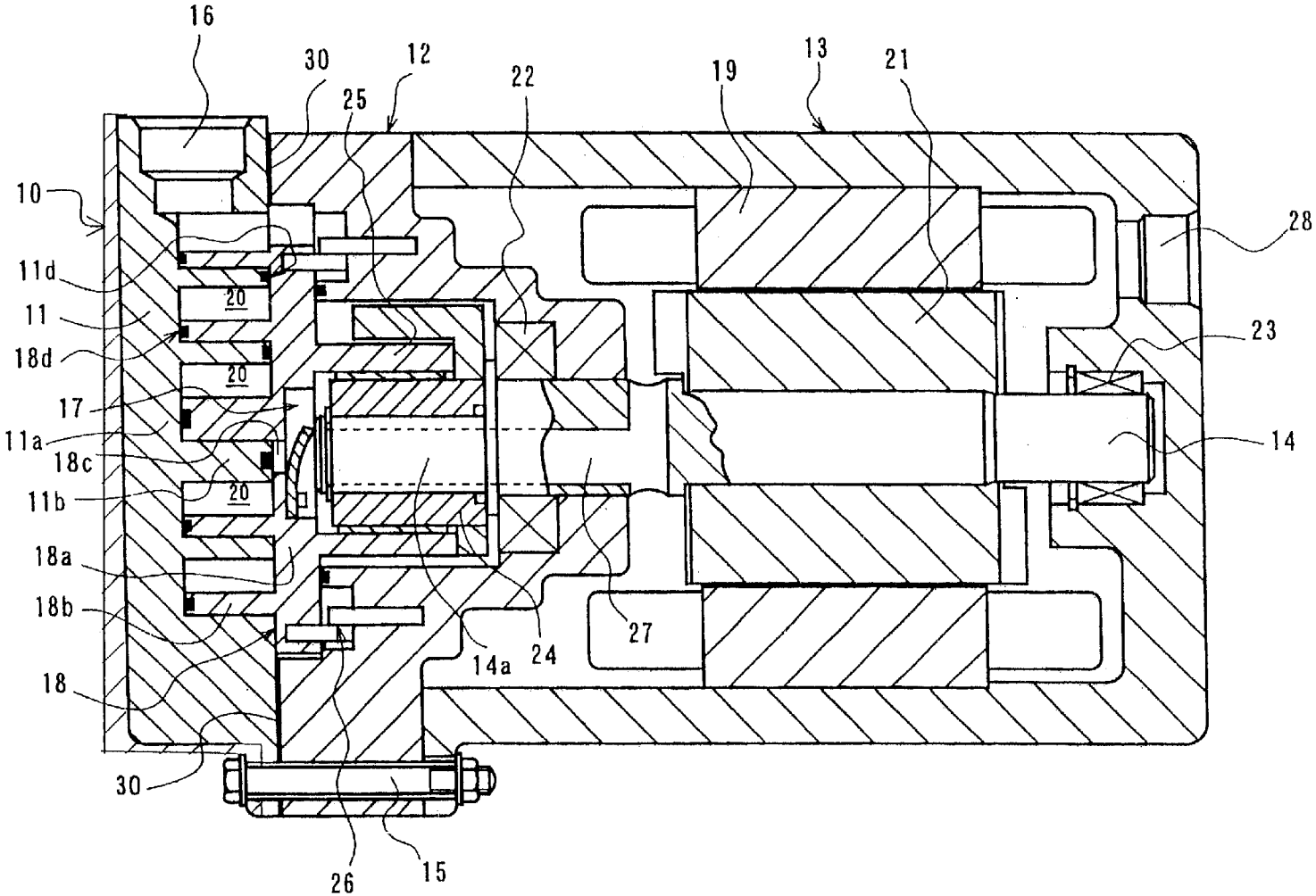
FIG. 1*b* is a diagram in a cross-sectional view illustrating another preferred embodiment of the scroll-type compressor according to the present invention.

In the present invention, the following alternative embodiments are also practiced. In the above preferred embodiment, as shown in FIG. 1*a,* the rear housing 10 and the fixed scroll member 11 are integrally formed. However, as shown in FIG. 1*b,* the fixed scroll member 11 may separately be formed from the rear housing 10. Accordingly, separate fixed scroll member 11 is assembled to the rear housing 10.

Figure 4:
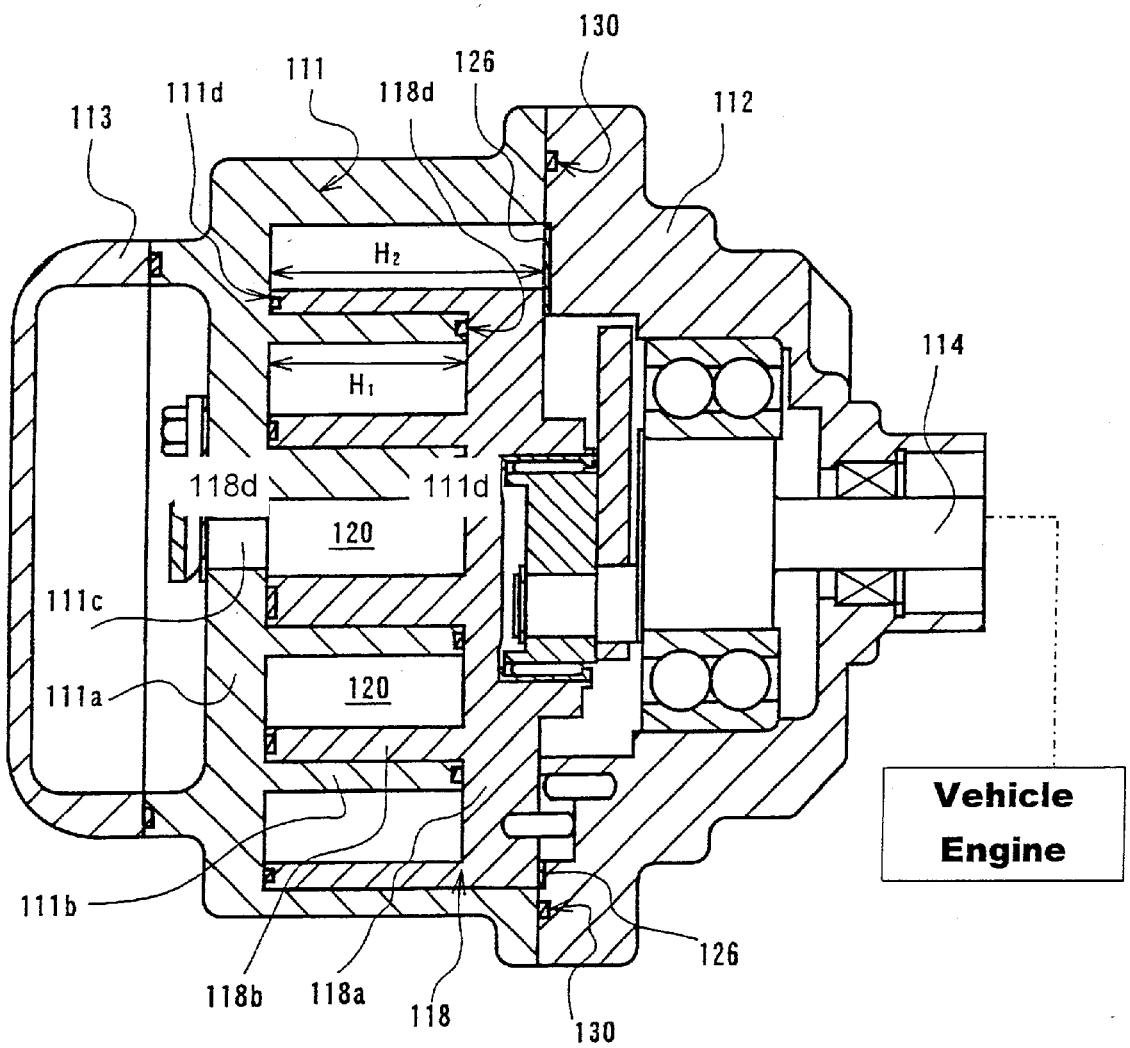
Fig. 4 (Prior Art)
FIG. 4 is a diagram in a cross-sectional view illustrating a scroll-type compressor according to the prior art.

In the above preferred embodiment, the electric motor is assembled in the compressor for driving the drive shaft 14. However, as shown in FIG. 4, a drive shaft may protrude outside a compressor. Accordingly, as the drive shaft 114 in FIG. 4 is connected to an engine, the drive shaft 14 in FIGS. 1*a* and 1*b* may also be connected to the external drive source such as the engine.

As described above, in the present invention, the sealing performance of the compression chambers 20 is retained by utilizing the pressure of the discharged refrigerant. In this case, mechanical adjustment is not required. Therefore, structure of the compressor becomes simple In addition, a simple gasket seal creates a sufficient seal between the front end surface of the rear housing and the rear end surface of the front housing.

The present examples and preferred embodiments are to be considered as illustrative and not restrictive and the invention is not to be limited to the details given herein but may be modified within the scope of the appended claims.

What is claimed is:

1. A scroll-type compressor comprising:

a fixed scroll member having a fixed scroll base plate and a fixed scroll volute portion;

a movable scroll member having a movable scroll base plate and a movable scroll volute portion, wherein said fixed scroll member and said movable scroll member cooperate to form a compression region, and wherein said movable scroll member orbits relative to said fixed scroll member to compress refrigerant in the compression region, and wherein the movable scroll base plate forms a rear surface and a discharge hole, pressure of the refrigerant discharged from the compression region being applied to the rear surface of the movable scroll base plate for enhancing a sealing effect in the compression region;

a rear housing accommodating said fixed scroll member;

a front housing located adjacent to said rear housing for at leas partially accommodating said movable scroll member; and a gasket seal located in contact with and between said front housing and said rear housing, said gasket seal having at least a continuous protrusion.

2. The scroll-type compressor according to claim 1 further comprising a drive shaft for orbiting said movable scroll member relative to said fixed scroll member.

3. The scroll-type compressor according to claim 2 further forming a discharge passage in said drive shaft.

4. The scroll-type compressor according to claim 2 wherein said drive shaft is rotated by a motor.

5. The scroll-type compressor according to claim 2 wherein said drive shaft is operably connected to a vehicle engine.

6. The scroll-type compressor according to claim 1 further comprising a discharge valve for opening and closing the discharge hole.

7. The scroll-type compressor according to claim 1 wherein said front housing and said movable scroll member define a discharge chamber communicating with the discharge hole.

8. The scroll-type compressor according to claim 1 wherein said fixed scroll member is separately formed from said rear housing.

9. The scroll-type compressor according to claim 1 wherein said fixed scroll member is integrally formed with said rear housing.

10. The scroll-type compressor according to claim 1 wherein said rear housing is said fixed scroll member.

11. The scroll-type compressor according to claim 1 wherein said gasket seal is coated with rubber.

12. A scroll-type compressor comprising:

a front housing;

a rear housing adjacent to said front housing having a fixed scroll member, said rear housing forming an inlet port for introducing refrigerant;

a movable scroll member accommodated in said front housing, wherein the fixed scroll member and said movable scroll member cooperate to form a compression region, wherein the refrigerant is introduced into the compression region and compressed by radially and inwardly orbiting said movable scroll member relative to the fixed scroll member, the movable scroll member forming a discharge hole substantially at the center for discharging the compressed refrigerant, a discharge pressure of the compressed refrigerant upon discharging from the compression region being at least partially applied to the movable scroll member; and a gasket seal with a predetermined amount of rigidity having a continuous protrusion, said gasket seal being located between said front housing and said rear housing, wherein the protrusion is at least partially press-contacted by said front housing and said rear housing.

13. The scroll-type compressor according to claim 12 wherein the fixed scroll member is separately formed from said rear housing.

14. The scroll-type compressor according to claim 12 wherein the fixed scroll member is integrally formed with said rear housing.

15. The scroll-type compressor according to claim 12 wherein said rear housing is the fixed scroll member.

16. The scroll-type compressor according to claim 12 wherein said front housing and said movable scroll member defining a discharge chamber communicating with the discharge holes.

* * * * *